US006923338B2

(12) United States Patent
Dees et al.

(10) Patent No.: US 6,923,338 B2
(45) Date of Patent: Aug. 2, 2005

(54) FOOD CONTAINER WITH INTERCHANGEABLE LID—BASE SEAL DESIGN

(75) Inventors: Jerome G. Dees, Appleton, WI (US); Rebecca E. Whitmore, Chilton, WI (US); Gerald J. Van Handel, Neenah, WI (US); Mark B. Littlejohn, Appleton, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 10/151,632

(22) Filed: May 20, 2002

(65) Prior Publication Data

US 2002/0175164 A1 Nov. 28, 2002

Related U.S. Application Data

(60) Provisional application No. 60/293,796, filed on May 25, 2001.

(51) Int. Cl.[7] ..... B65D 41/18
(52) U.S. Cl. ..... 220/793; 220/4.24
(58) Field of Search ..... 220/4.24, 4.21, 220/4.25, 790–794, 797, 784, 804, 799, 783, 805

(56) References Cited

U.S. PATENT DOCUMENTS

| | | | | | |
|---|---|---|---|---|---|
| 2,999,611 | A | * | 9/1961 | Paulson | 220/4.24 |
| 3,565,146 | A | * | 2/1971 | Arnolds | 220/4.23 |
| 3,620,403 | A | | 11/1971 | Rujmp | 220/4 E |
| 3,664,538 | A | | 5/1972 | Fioretti | 220/4 E |
| 3,704,779 | A | | 12/1972 | Nigg | 206/47 R |
| 3,933,295 | A | * | 1/1976 | Congleton | 229/406 |
| 4,195,746 | A | * | 4/1980 | Cottrell | 220/4.24 |
| 4,294,371 | A | | 10/1981 | Davis | 220/4 E |
| 4,360,118 | A | | 11/1982 | Stern | 220/4 E |
| 4,838,444 | A | * | 6/1989 | Bitel | 220/4.24 |
| 4,974,738 | A | * | 12/1990 | Kidd et al. | 220/4.24 |
| 5,036,980 | A | | 8/1991 | VIgue et al. | 206/515 |
| 5,046,659 | A | * | 9/1991 | Warburton | 220/4.22 |
| 5,377,860 | A | | 1/1995 | Littlejohn et al. | 220/306 |

* cited by examiner

*Primary Examiner*—Lien Ngo
(74) *Attorney, Agent, or Firm*—Michael W. Ferrell

(57) ABSTRACT

There is provided a container having both male and female sealing regions disposed about its periphery in a pattern making it possible to seal a container with another container having substantially identical sealing regions. The male sealing regions used in the practice of the present invention may take the form of a U-shaped ridge which is undercut along at least one leg of the U. Typically, a container will he thermoformed from lightweight thermoplastic material giving the U-shaped ridge considerable flexibility. The female sealing regions used in the practice of the invention may take the form of an undercut channel adapted to receive and match the undercut U-shaped ridges found in the male portion of the container wherein the walls and base of the channel are sufficiently flexible that the undercut portions of the U-shaped ridge are urged into engagement with the undercut portions of the channel and the crest of the ridge is urged into the channel.

78 Claims, 13 Drawing Sheets

FOOD CONTAINER WITH INTERCHANGEABLE LID— BASE SEAL DESIGN

CROSS-REFERENCE TO RELATED APPLICATION

This application is based upon United States Provisional Application No. 60/293,796, of the same title, filed on May 25, 2001, the priority of which is hereby claimed.

TECHNICAL FIELD

The present invention relates generally to containers, and in particular to a container formed of a thermoplastic material having an interlocking rim structure defined about the periphery thereof. The interlocking rim structure has at least one undercut male ridge section and at least one undercut female groove section defined therein; these respective sections are configured such that male and female sections on a food container having a substantially identical interlocking rim structure will seal in interpenetrating engagement therewith. In one particularly preferred embodiment, the sealing portions of upper and lower sections of the container are identical.

BACKGROUND ART

Conventional food service containers for serving or storing food are well known. The prior art is replete with such containers; one preferred container being disclosed in U.S. Pat. No. 5,377,860 to Littlejohn el al. In the '860 patent there is disclosed a food container which is a combination of a base portion and a lid portion made of a resilient polymeric material. The base is a unitary component including an upwardly projecting, peripherally extending sealing rim having inner and outer sealing areas. The lid is also a unitary component including a peripherally extending sealing channel correspondingly shaped to receive the sealing rim of the base and particularly, to engage the rim at the inner and outer sealing areas. Because both the base and lid are made from a resilient material, the inner and outer sealing materials are shaped to provide a self-reinforcing seal configuration wherein the initial engagement of either the inner or the outer seals urges the other seal into engagement. This feature is reported to permit a wide tolerance of variations in the size of the lid and the base.

Various designs have also been proposed for nestable food containers which are reversible to define a lower portion and an upper portion. There is disclosed, for example, in U.S. Pat. No. 5,036,980 to Vigue et al. a nestable food container which is reversible to define a dish or a cover in a composite container. A male and female locking arrangement is provided on the container together with a stabilizing system of protrusions and depressions to stabilize the locked container engagement.

In U.S. Pat. No. 4,974,738 to Kidd et al. there is shown a container provided with a tray component and an independent cover component which is adapted to assume open and closed modes with respect to the tray component. The components are interchangeable and each is provided with a recessed center portion having a base delimited by an angularly extending wall. An edge of the wall defines an open side. Each component also includes a laterally extending rim protruding outwardly from the wall edge. A predetermined first portion of the rim is provided with a first lock member and a predetermined second portion of the rim is provided with a second lock member. When the components are in the closed mode the first lock member of the tray component is in interlocking engagement with the second lock member of the cover component and vice versa.

In U.S. Pat. No. 4,360,118 to Stern there is disclosed a self-mating pizza pie container. The container includes a pair of circular, shallow container lower and upper half sections, integrally molded of a lightweight, thermally insulating material. Formed along their peripheral sidewalls are mutually interfitting and interlocking means which are configured to be readily releasable for uncovering a contained pizza. Each half section has in its peripheral rim a diagonally opposed locating pin and locating recess for the interfitting reception of the complemental locating and pin recess of the companion half section for relative rotational locating of the two half sections.

U.S. Pat. No. 4,195,746 to Cottrel discloses a food container for the storage and transport of food; especially a hot food such as pizza. The container includes identical upper and lower portions each portion having a flat base surface, outwardly extending sidewalls and a circumferential lip thereabout. A locking portion is carried on the lip to releasably lock the upper and lower portions together. A plurality of vertical honeycombs on the interior of the base surface and a plurality of buttresses are formed in the interior sidewalls.

U.S. Pat. No. 4,294,371 to Davis discloses a food container; in particular, a sundae dish having a bottom dish and a cover that are identical. The rim structure of each part is part male and part female. Each dish is provided with a locking element. The two parts of the container are self-aligned by virtue of the rim structures so that when one is inverted on the other the locking elements are aligned for convenient locking of the container.

U.S. Pat. No. 3,704,779 to Nigg discloses a food tray made of a plastic material with integral break off cutlery. The device includes a substantially rectangular receptacle portion for containing food items and free cutlery pieces protected by a surrounding reinforced frame and arranged so they can be easily broken off by a user. Moreover, the tray maybe detachably secured to another tray to form a closed container as is noted in Column 2, line 38 and following.

In U.S. Pat. No. 3,664,538 to Fioretti there is disclosed a nestable food receptacle including a bottom and plurality of upstanding ear members on the periphery of the bottom member. First ear members alternate in position on the periphery with the second ear members. The receptacles when engaged to one another form a container having a cavity between the bottom members of the receptacles defined by the vertical dimension of the walls of the ear members.

U.S. Pat. No. 3,620,403 to Rump discloses a thin wall thermoplastic container which includes identical dish and cover portions. Each portion has a peripherally extending flange for supporting the other when one is placed on the other to form the assembled container.

SUMMARY OF THE INVENTION

The male sealing regions used in the practice of the present invention may take the form of a U-shaped ridge which is undercut along at least one leg of the U. Typically containers of the present invention will be thermoformed from lightweight thermoplastic material giving the U-shaped ridge considerable flexibility. The female sealing regions used in the practice of the present invention take the form of an undercut channel adapted to receive the undercut U-shaped ridges found in the male portion of the container wherein the walls and base of the channel are sufficiently flexible that the undercut portions of the U-shaped ridge are urged into engagement with the undercut portions of the channel and the crest of the ridge is urged into the channel. Preferably, the crest of the ridge is urged into engagement with the bottom of the channel and more preferably both a medial portion of the crest of the U-shaped ridge and a mating medial portion of the bottom of the corresponding channel take the form of substantially mating surfaces so that as the undercut portions of the channel and the undercut portions of the U-shaped ridge are urged into engagement, substantial surface-to-surface contact between the medial portions of the crest of the U-shaped ridge and the bottom of the channel will form an additional seal, although this is not required for all applications. In preferred embodiments, both legs of the U's will be undercut.

There is provided in accordance with the present invention a thermoplastic container having an interlocking rim structure defined about the periphery thereof, the interlocking rim structure having at least one undercut male ridge section and at least one undercut female groove section defined therein. The male and female sections are configured such that male and female sections on substantially identical food containers will seal with interpenetrating resilient engagement about the periphery of the container. The undercuts on the ridges and grooves are configured to urge the rim structures on substantially identical containers into sealing engagement. There is typically provided terminal portions of the ridge sections which transition into the groove sections, defining male transition surfaces on the ridge sections and female transition surfaces on the groove sections. The male transition surfaces and the female transition surfaces are configured to be urged into sealing surface to surface engagement with like transition surfaces upon interpenetration of male and female sections of said container with male and female sections of a substantially identical thermoplastic food container. Alternatively, the transition surfaces may be of any substantially mating geometry, including planar, lobed or arcuate.

More generally, in another aspect of the present invention there is provided a thermoplastic container having an interlocking rim structure defined about the periphery thereof, the interlocking rim structure having at least one undercut male ridge section and at least one undercut female groove section defined therein. The male and female sections are configured such that the male and female sections on a food container having a substantially identical interlocking rim structure will seal with interpenetrating resilient engagement about the periphery of the container. The undercuts on the ridges and grooves are configured to urge the rim structures on containers having substantially identical interlocking rim structures into sealing engagement. Here again, the terminal portions of the ridge sections transition into the groove sections, defining male transition surfaces on the ridge sections and female transition surfaces within the groove section. The male transition surfaces and the female transition surfaces are configured to be urged into sealing surface to surface engagement upon interpenetration of male and female sections of the thermoplastic food container having a substantially identical interlocking rim structure.

There is provided in another aspect of the present invention, a container integrally formed of a thermoplastic material having an interlocking rim structure about a rim plane defined about the periphery thereof, the interlocking rim structure including: (a) at least one male ridge section projecting upwardly from the rim plane extending circumferentially over at least a portion of the periphery of the container having at its terminal portions declivitous sealing surfaces projecting downwardly toward the rim plane; (b) at least one female groove section adjacent the male ridge section extending circumferentially over at least a portion of the periphery of the container having at its terminal portions acclivitous sealing surfaces projecting upwardly toward the rim plane, wherein the acclivitous surfaces are abutting the declivitous surfaces. The interlocking rim structure is configured to seal with a substantially identical rim structure rotated 180° about an axis of rotation such that when the male ridge sections disposed in sealing engagement with corresponding female groove sections the ridges and grooves are urged into surface-to-surface engagement and corresponding acclivitous and declivitous surfaces are urged into surface-to-surface sealing contact.

A typical container is integrally formed of a thermoplastic material having an interlocking rim structure about a rim plane defined about the periphery thereof, the interlocking rim structure including:

(a) at least one male ridge section projecting upwardly from the rim plane extending circumferentially over at least a portion of the periphery of the food container having two terminal portions with inclined declivitous surfaces extending from the top surface of said male ridge section to about the rim plane;

(b) at least one female groove section adjacent the aforesaid male ridge section projecting downwardly from the rim plane extending circumferentially over at least a portion of the periphery of the food container having two terminal portions with inclined acclivitous surfaces extending from the bottom surface of the groove upwardly to about the rim plane in proximity to the inclined declivitous surfaces. The inclined acclivitous surfaces may be circumferentially offset with respect to the inclined declivitous surfaces. The rim structure is configured such that it defines an axis of rotation in the rim plane extending between at least one of the inclined declivitous surfaces and at least one of the inclined acclivitous surfaces. The rim structure is configured to seal with an identical rim structure rotated 180° about the axis of rotation such that the male ridge sections are disposed in sealing engagement with the female groove sections and the terminal inclined surfaces engage to form circumferential interlocks around the periphery of the container. The axis of rotation passes through and preferably lies in the rim plane and is generally characterized in that the rim of a container rotated 180° about its axis of rotation will seal with a substantially identical rim section. These and other features of the present invention will become readily apparent from the following drawings and description.

BRIEF DESCRIPTION OF DRAWINGS

The invention is described in detail below with reference to the various figures wherein.

In the various embodiments, like numbers indicate identical parts.

DETAILED DESCRIPTION

Figure 1A:
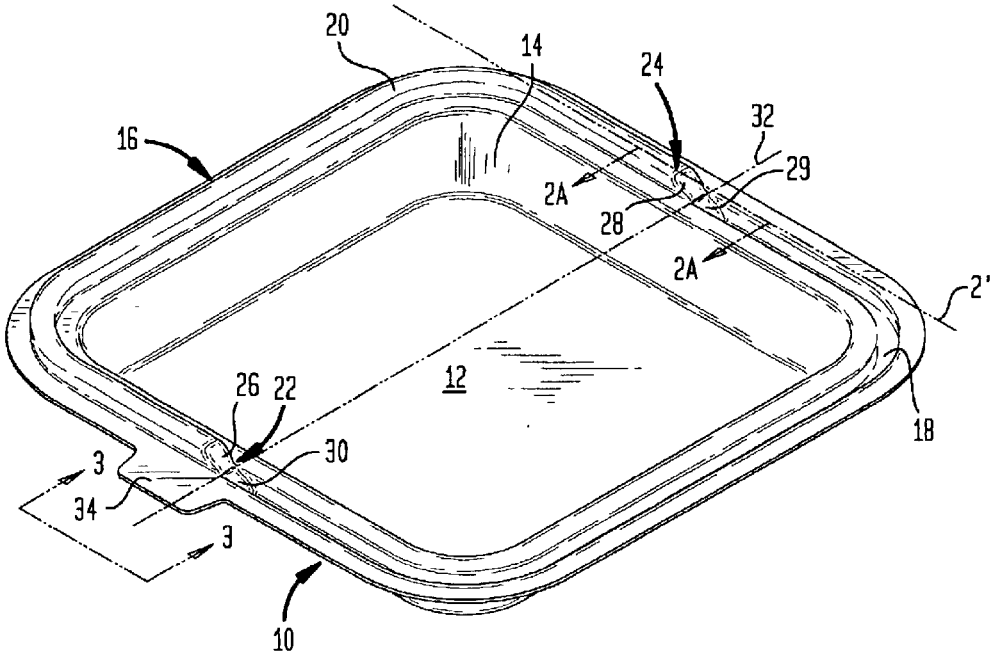
FIG. 1A is a view in perspective of a food container configured in accordance with the present invention.

Referring to FIGS. 1A through 5, there is shown a first embodiment of a container configured in accordance with the present invention. There is provided generally a container 10 of generally square configuration being about 6 inches or so about the inside of its interior. This container may be made from polystyrene or polypropylene sheet having a thickness, for example, of from about 5 or 10 to about 50 thousandths of an inch (mils) or any other suitable thermoplastic material as noted herein. Mineral filled polypropylene, especially mica filled polypropylene is, for example, suitable. Other suitable flexible and resilient materials include other polyolefins such as polyethylene, or other polymers such as styrenes, polyesters, polyamides, polyacrylates, polysulfones, polyetherketones, polycarbonates, acrylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides, and engineered resin derivatives thereof. These materials may be filled or unfilled, solid (continuous) or foamed. When made from a foamed polymeric material such as, for example, polystyrene foam or polypropylene foam, the sheet thickness may be slightly more than when a solid polymeric material is employed. A foamed wall thickness of from about 5 or 10 up to about 80 mils, for example, may be employed. Food container 10 includes a planar central container portion 12 adjacent an upwardly extending sidewall 14 which, in turn, is integrally formed from the thermoplastic sheet with a rim portion 16 which extends about the periphery of container 10. Rim portion 16 includes a female undercut groove portion 18 as well as a male undercut ridge portion 20 with transition sections 22, 24 therebetween. Transition section 22 includes an inclined male transition surface 26 and an inclined female transition surface 30 as will be discussed in more detail hereinafter. Likewise, transition section 24 includes an inclined male transition surface 28 as well as an inclined female transition surface 29. Food containers configured in accordance with the present invention typically define an axis of rotation 32 as is shown in FIG. 1A. The inventive containers will form a sealed closed container as is shown for example in FIG. 1B if pressed into sealing engagement with an identical container rotated 180° about the axis of rotation. Typically, the axis of rotation passes through the plane of rim portion 16 and about the middle of a transition section, for example, between at least one pair of inclined transition surfaces such as surfaces 28, 29 as described in more detail below. There is further provided a tab 34 at the periphery of rim portion 16 which is off set with respect to axis of rotation 32 such that when paired with an identical container the respective tabs will be slightly offset so as to promote ease of opening a sealed container. Tabs may more preferably be disposed away from transition sections and/or axis of rotation and particularly preferred containers may have a plurality of tabs as discussed in more detail hereinafter.

As used herein, the terminology "male" generally refers to a part projecting away from planar container portion 12 (i.e. the bottom or dome of a container) whereas the terminology "female" generally refers to a part projecting toward the planar container portion such as portion 12. In the case of the transition portions the female inclined surfaces may be offset towards the container bottom, whereas the inclined male transition surfaces may be offset away from the container bottom or dome. This terminology is perhaps better understood by reference to FIG. 1B which is a view in perspective of container 10 of FIG. 1 where a second container 36, substantially identical in all respects to container 10 has been rotated 180° about its axis of rotation and pressed into sealing engagement with the corresponding parts of container 10 of FIG. 1A. Thus female undercut groove portion 38 of second container 36 is pressed into sealing engagement with male undercut ridge section 20 of container 10 whereas male undercut rim portion 40 of container 36 is pressed into sealing engagement with female undercut portion 18 of container 10. Likewise the transition sections 22 and 24 are mated so that the corresponding male and female portions interconnect as can be seen in the various diagrams.

Figure 1B:
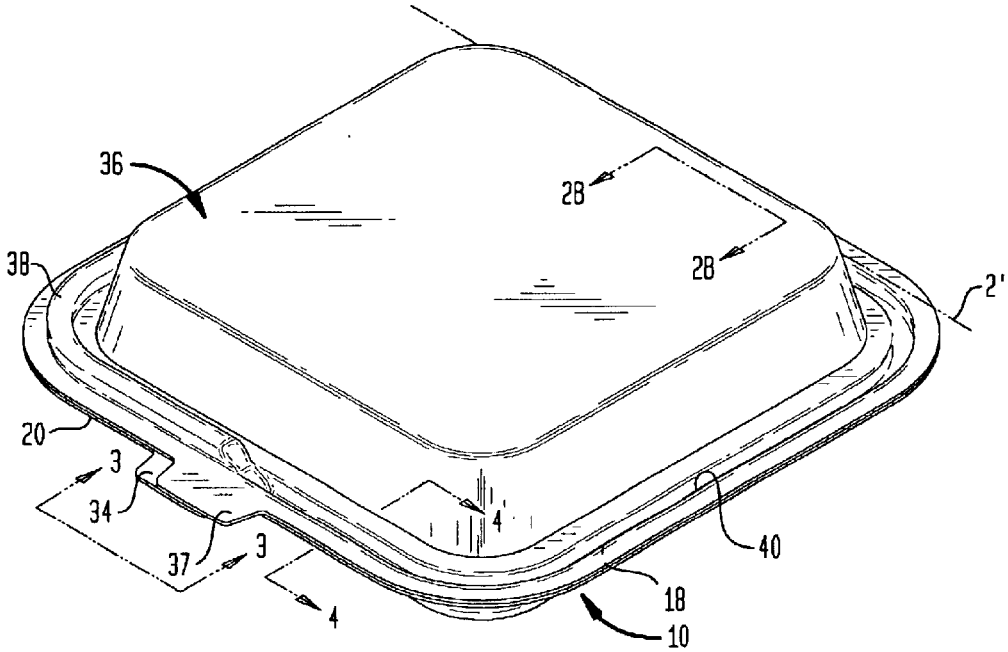
FIG. 1B is a view in perspective of the food container of FIG. 1A shown in sealing engagement with another, identical food container to form a closed food container in accordance with the present invention.
Figure 2A:
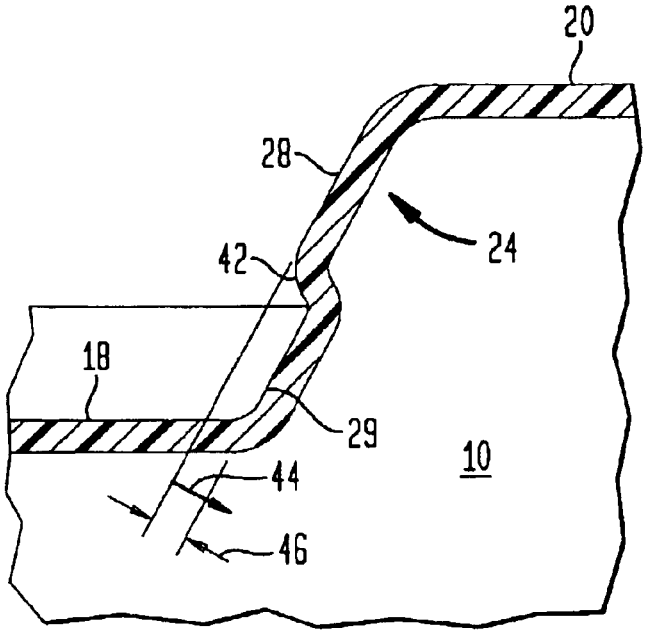
FIG. 2A is a partial view in section and elevation along line 2A—2A of FIG. 1A showing the circumferential lip profile of the food container section of FIG. 1A about a transition from ridge to groove.
Figure 2B:
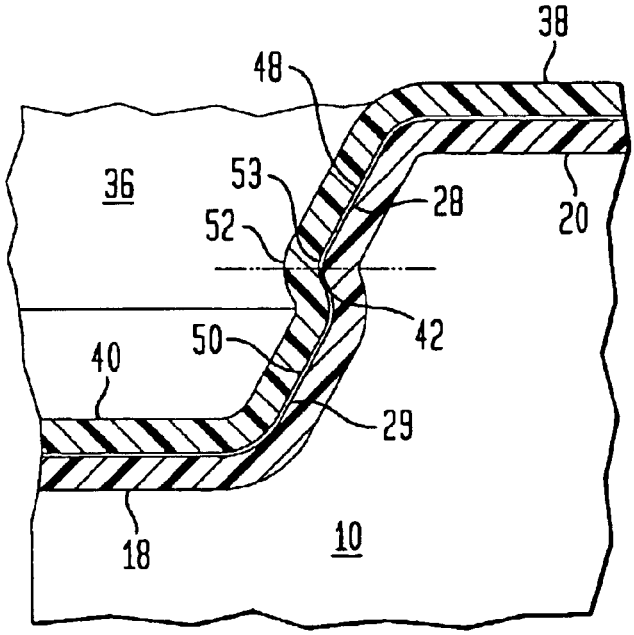
FIG. 2B is a partial view in elevation and section along line 2B—2B showing the circumferential profile of the rim sections of the upper and lower containers of FIG. 1B about the transition from ridge to groove.

In this respect, FIG. 2A and FIG. 2B are views in partial section in the directions shown by lines 2A—2A in FIGS. 1A and 2B—2B in FIG. 1B respectively. The diagrams are in section in that they are in the center line of groove 18 and ridge 20 as shown by dashed line 2' in FIGS. 1A and 1B. It can be seen in FIG. 2A that male undercut ridge section 20 transitions to female undercut groove section 18 about the circumference of container 10 by way of transition section 24. Section 24 comprises an upper inclined male transition surface 28 and a lower inclined female transition surface 29 as shown in the diagram. It will be appreciated from FIG. 2A that female inclined transition surface 29 is circumferentially offset from inclined male transition surface 28 generally in the direction indicated by arrow 44 which is toward the bottom or planar central portion 12 of container 10. The surfaces are offset a distance 46 between the planes generally defined by surface 28 and the plane generally defined by surface 29.

The operation of the inventive design of the transition regions is further appreciated by reference to FIG. 2B. In FIG. 2B, it can be seen that female undercut groove section 18 mates with male undercut rim portion 40 of container 36 whereas male undercut ridge portion 20 mates with female undercut rim portion 38 of container 36. Likewise, inclined male transition surface 28 matches with inclined female transition surface 48 whereas inclined female transition surface 29 of container 10 matches with inclined male transition surface 50 of container 36 to provide surface to surface engagement between the various corresponding transition surfaces as noted above. Further, inasmuch as container 10 and container 36 are substantially identical, the ridges such as ridges 42 and 52 will be pressed into sealing engagement as shown in FIG. 2B where ridge 42 is in valley 53 opposite ridge 52. Likewise since the surfaces are substantially identical, surfaces 28 and 48 are pressed together while surfaces 50 and 29 are pressed together as shown in FIG. 2B in order to provide a circumferential interlock about the transition section of the container.

Figure 3:
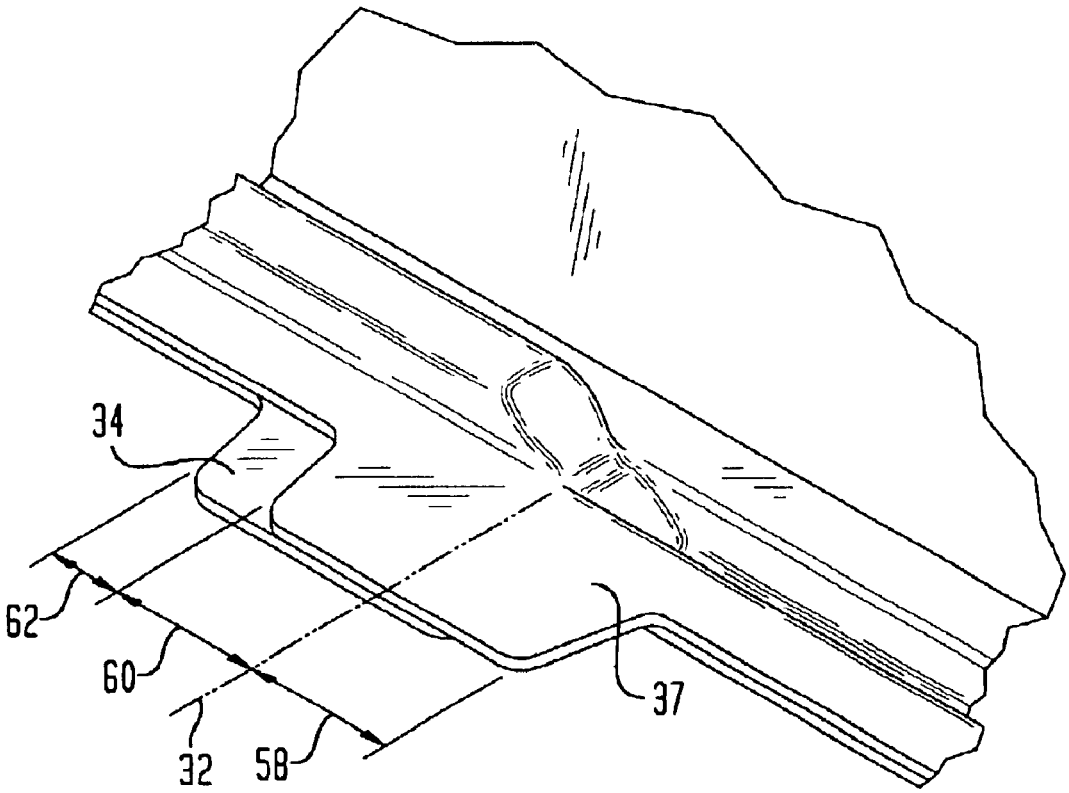
FIG. 3 is a view generally along line 3—3 of FIG. 1B showing offset tabs on the square food containers of FIG. 1B.

FIG. 3 is a detail of the closed container of FIG. 1B shown generally about line 3—3 of FIG. 1B wherein it will be appreciated the geometry of the offset tabs of the invention with respect to the rim design. In general, a tab such as tab 34 of container 10 or tab 37 of container 36 is offset from the axis of rotation indicated in FIG. 3 as 32 in the sense that the tab is longer on one side of the axis of rotation than the other. That is to say, a circumferential distance 58 may be less than a circumferential distance 60 by anywhere from about 10 to about 40 percent (based on distance 60) such that when inverted and placed about an identical container there will be an offset distance 62 which will make it possible for a user to easily separate the two containers by simply grasping the tabs between a thumb and forefinger and pressing as would be appreciated from the diagram of FIG. 3. Perhaps more preferably, the containers of the invention are provided with two tabs spaced away from the transition regions and axis of rotation as discussed hereinbelow.

Figure 4:
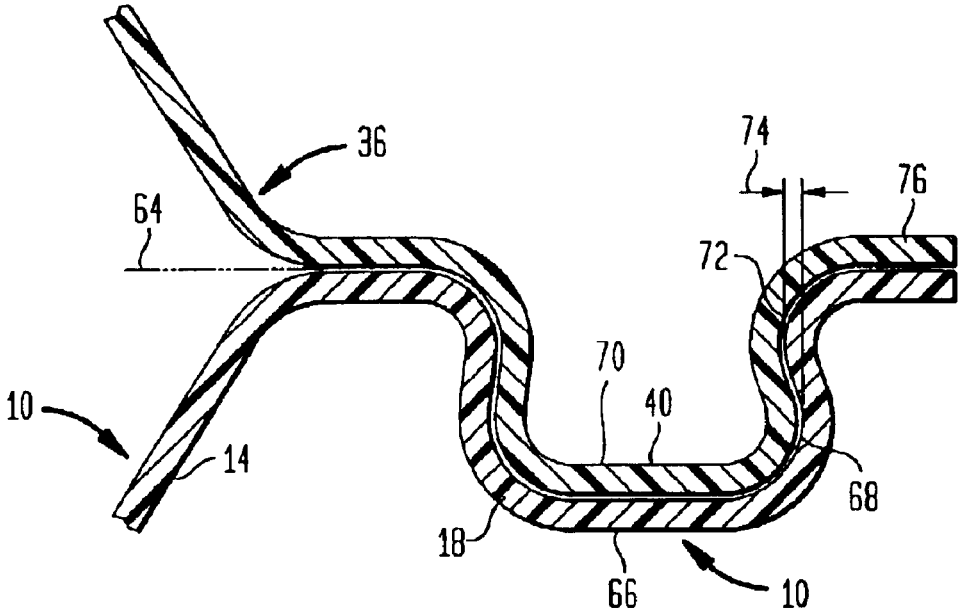
FIG. 4 is a schematic sectional view generally along line 4—4 of FIG. 1B showing the rim profile from center of two containers in sealing engagement wherein the rim profile is shown moving outwardly from the center of the container.

The U-shaped radial profile of the main portions of the rim is perhaps better appreciated by reference to FIG. 4 which is a schematic view generally along the line 4—4 of FIG. 1B in elevation showing the interlocking rim geometry (profile from center) as one goes outwardly from sidewall 14 of container 10. In general, when mated the two containers are pressed together they seal about their respective rim-planes which are generally indicated at 64. Plane 64 is, in general, the plane in which the rim of the food container is defined, notwithstanding the fact that it will have respective male and female portions thereof which project upwardly and downwardly with respect to the rim plane as can be seen in FIG. 4. The axis of rotation is typically located in plane 64. As can be seen in the diagram, undercut groove section 18 is generally U-shaped with a medial portion 66 and an undercut portion 68. Likewise, container 36 is substantially identical to container 10, and male undercut rim portion 40 is likewise U-shaped and has a medial portion 70 and an undercut portion 72. Typically the undercut portion (on both the male ridge sections and female groove sections) is undercut a distance 74 as indicated on FIG. 4, typically a distance of about 5 or 10 mils to about 20 mils when using sheet stock of from 15 to 25 mils to form the containers of the invention. Typically, the maximum width of the male ridge exceeds the minimum width of the female grooves by about 10 to 20 mils. Foamed products may have larger size differentials up to 80 mils. There may further be provided an outer rim portion 76 for example of container 36 which may be flat or may be provided with further features and curvatures for strength if so desired as is discussed in connection with FIG. 5A and following.

The containers of the invention may be made by any suitable technique, that is, techniques employed for forming plastics. The products may thus be made from thermoplastic sheet thermoformed by the application of vacuum or thermoformed by a combination of vacuum and pressure into the products of the invention. Alternatively, the inventive containers may be made from a plastic material by injection molding, injection blow molding, compression molding, injection stretch blow molding, composite injection molding and so forth. Thermoforming from plastic sheet is particularly preferred.

Generally speaking, thermoforming is the pressing and/or stretching of heated deformable material into final shape. In the simplest form, thermoforming is the draping of a softened sheet over a shaped mold. In the more advanced form, thermoforming is the automatic high speed positioning of a heated sheet having an accurately controlled temperature into a pneumatically actuated forming station whereby the article's shape is defined by the mold, followed by trimming and regrind collection as is well known in the art. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet rollfed forming any suitable combinations of the above. Details are provided in J. L. Throne's book, *Thermoforming*, published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse in order to simulate a natural or grain like texturized look. Suitable formed articles are trimmed in line with a cutting die and regrind is optionally reused since the material is thermoplastic in nature. Other arrangements for productivity enhancements include the simultaneous forming of multiple articles with multiple dies in order to maximize throughput and minimize scrap.

It will be appreciated from the foregoing discussion that the male sealing regions used in the practice of the present invention may take the form of a U-shaped ridge such as ridge 40, which is undercut along at least one leg of the U for example at 72. Typically containers of the present invention will be thermoformed from lightweight thermoplastic material giving the U-shaped ridge considerable flexibility. Particularly preferred materials include polystyrenes such as impact modified polystyrene or oriented polystyrene or polyolefins such as polyethylene or polypropylene. Filled polypropylenes, particularly mineral-filled including mica-filled polypropylenes such as are disclosed in U.S. Pat. No. 6,211,501 to McCarthy et al.(incorporated herein by reference) are likewise suitable. The female sealing regions used in the practice of the present invention may take the form of an undercut channel 18 undercut at 68 adapted to receive the undercut U-shaped ridges 40 found in the male portion of a container wherein the walls and base of the channel are sufficiently flexible that the undercut portions of the U-shaped ridge are urged into engagement with the undercut portions of the channel. Preferably, the crest of the ridge is urged into engagement with the bottom of the channel, and more preferably, both a medial portion 70 of the crest of the U-shaped ridge and a mating medial portion 66 of the bottom of the corresponding channel form mating surfaces so that as the undercut portions 68 of the channel and the undercut portions 72 of the U-shaped ridge are urged into engagement, substantial surface to surface contact between the medial portions of the crest of the U-shaped ridge and the bottom of the channel will form an additional seal. The transition sections between the male ridge sections and the female grooves preferably form a circumferential interlock as is perhaps best appreciated from FIG. 2B. The interlocks include a first mating region where inclined planar declivitous surface 28 of container 10 is urged into surface to surface engagement with inclined planar acclivitous surface 48 of container 36, a second sealing region where transition ridge 42 of container 10 is urged into engagement with a valley 53 (the back of ridge 52) of container 36 and a third sealing region where inclined planar acclivitous surface 29 of container 10 is urged into surface to surface engagement with inclined planar declivitous surface 50 of container 36. There is thus shown in the various figures a thermoplastic food container having an interlocking rim structure defined about the periphery thereof, the interlocking rim structure having at least one undercut male ridge section and at least one undercut female groove section defined therein, the male and female sections being configured such that male and female sections on a food container having a substantially identical interlocking rim structure will seal with interpenetrating resilient engagement about the periphery of said food service container, the undercuts on the ridges and grooves being configured to urge the rim structure on containers having a substantially identical interlocking rim structure into sealing engagement. Typically terminal portions of the ridge sections transition into the groove sections, defining male transition surfaces on the ridge sections and female transition surfaces within the groove sections, the male transition surfaces and the female transition surfaces being configured to be urged into sealing surface to surface engagement upon interpenetration of male and female sections of a thermoplastic food container having a substantially identical interlocking rim structure. In some preferred embodiments, two identical containers are sealingly engaged to form an enclosed container. In some cases, the rim includes a peripheral tab asymmetrically disposed about an axis of rotation of the interlocking rim structure such that the peripheral tab will be offset with respect to a substantially identical tab on a substantially identical interlocking rim structure when engaged thereto in sealing engagement. In still yet other embodiments to be discussed below, tabs will be located away from the transition regions and will substantially overlap each other. When tabs are not located adjacent to the axis of rotation, it is normally preferable to use at least two overlapping tabs. The tabs are typically offset by a distance of from about 10 to about 40% of their circumferential length if they are located adjacent the axis of rotation. The containers of the invention may be made of any suitable thermoplastic material, preferably (for reasons of cost) by way of thermoforming a sheet of material into a container of substantially uniform wall thickness or caliper. The sheet of thermoplastic material may be a polymeric material selected from the group consisting of: polyesters, polystyrenes, polypropylenes, polyethylenes and mixtures thereof and the container may have a wall thickness of from about 5 or 10 to about 50 mils. A wall thickness of from about 15 mils to about 25 mils is typical for some applications, or slightly less depending on the draw ratio. One particularly preferred type of thermoplastic sheet is mica-filled polypropylene sheet including from about 40 to about 90% by weight polypropylene and from about 10 to about 50% by weight mica. Calcium carbonate is optionally included in the polypropylene mica material. In some instances it may be desirable to add one or more adjuvants to the polymer such as impact modifiers, UV stabilizers, antioxidants or thermal stabilizers as are known in the art in addition to mineral fillers.

It will be appreciated from the discussion which follows that the transition sections between the male ridge sections and female groove sections typically include a declivitous male section extending downwardly from the top, typically medial position, of the ridge to abut the acclivitous transition surface extending upwardly from the bottom of the groove. The acclivitous surfaces may be circumferentially offset with respect to declivitous surfaces or coplanar with them or take any suitable shape. In one embodiment, the surfaces have matched, spherically lobed portions.

Figure 5A:
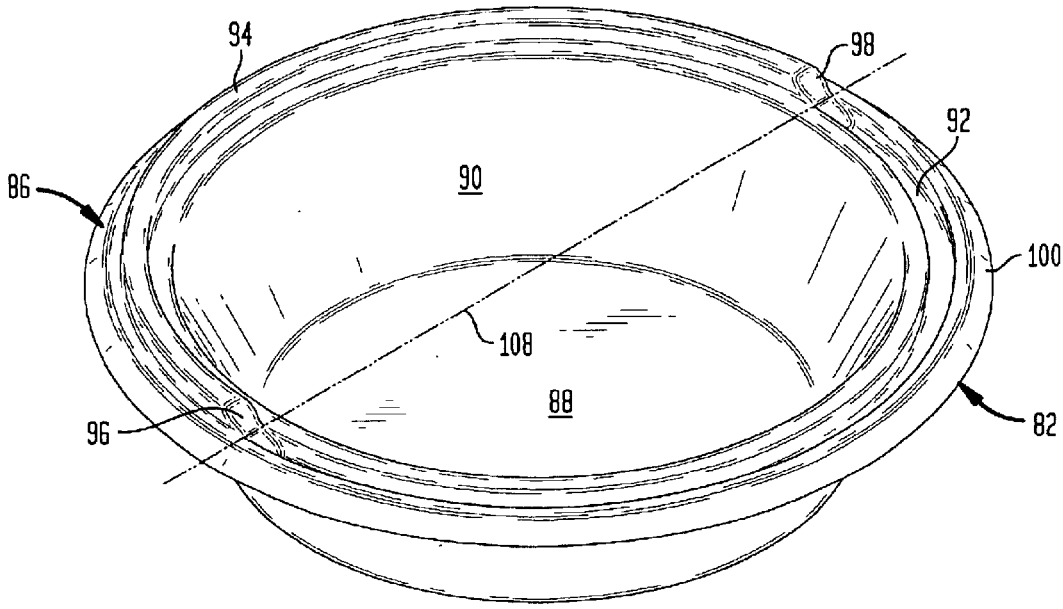
FIGS. 5A through 5D are views in perspective of an alternate embodiment of the present invention.
Figure 5B:
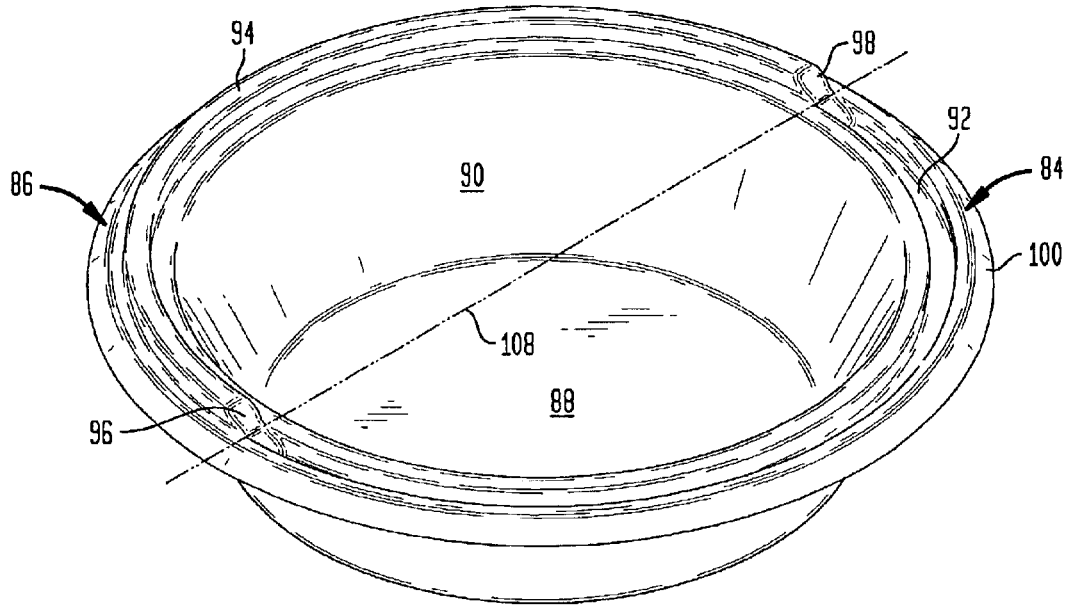

An alternate embodiment of the present invention is shown in FIGS. 5A through 5D. In general, the food containers of FIGS. 5A through 5D incorporate the features of the food containers of FIG. 1A through FIG. 4. The containers of FIGS. 5A through 5D, however, are generally configured as bowls having a diameter of about 5 inches or so and a height of about 1⅜ inch. Like the containers of FIG. 1A and following the container 82 and container 84 of FIGS. 5A and 5B each include a rim portion 86, a planar container portion 88 for forming the bottom or a dome of a closed container, a sidewall 90, a female undercut groove section 92 of the rim, a male undercut ridge section 94 of the rim, a transition section 96 and a transition section 98. Each of these items has the various features described above. There is defined by the containers an axis of rotation 108 which passes through the central portion of transition sections 96, 98 as shown in FIGS. 5A and 5B. Unlike the embodiment of FIG. 1A and following, the embodiment of FIGS. of 5A–5D includes an outer circumferential skirt 100 which is downturned, that is, turned down towards the planar surface 88 of the containers. Circumferential skirt 100 provides strength and also provides a means for a user to tightly press two identical containers such as containers 82 and 84 together as well as separate them when it is desired to open the container to expose the hot food for example.

Figure 5C:
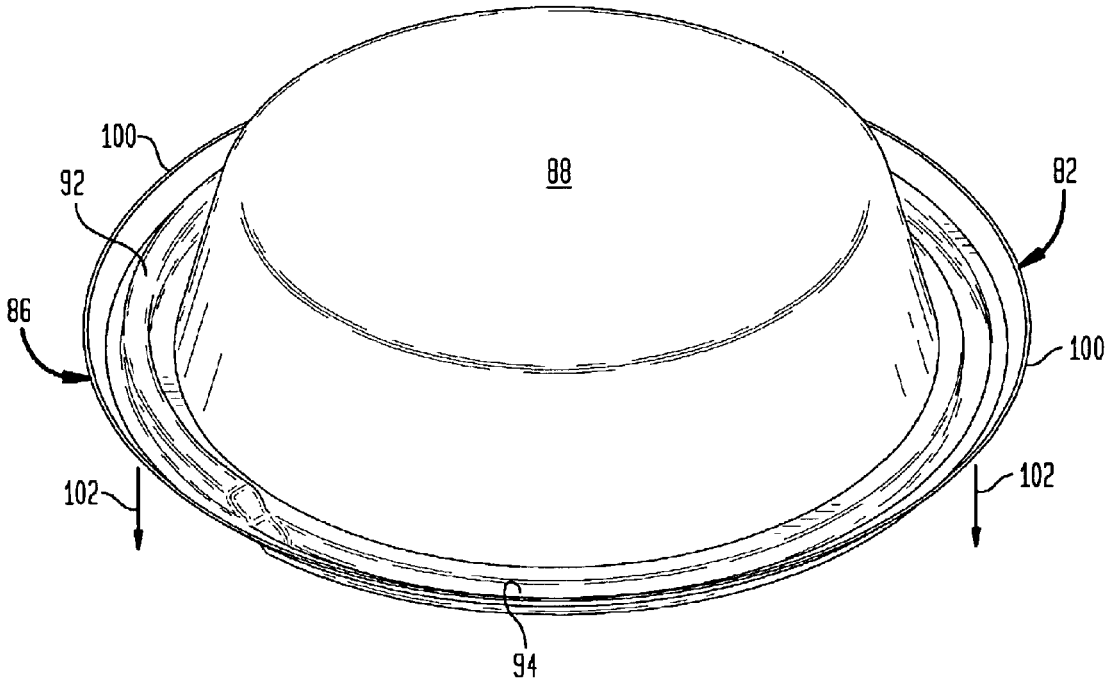
Figure 5D:
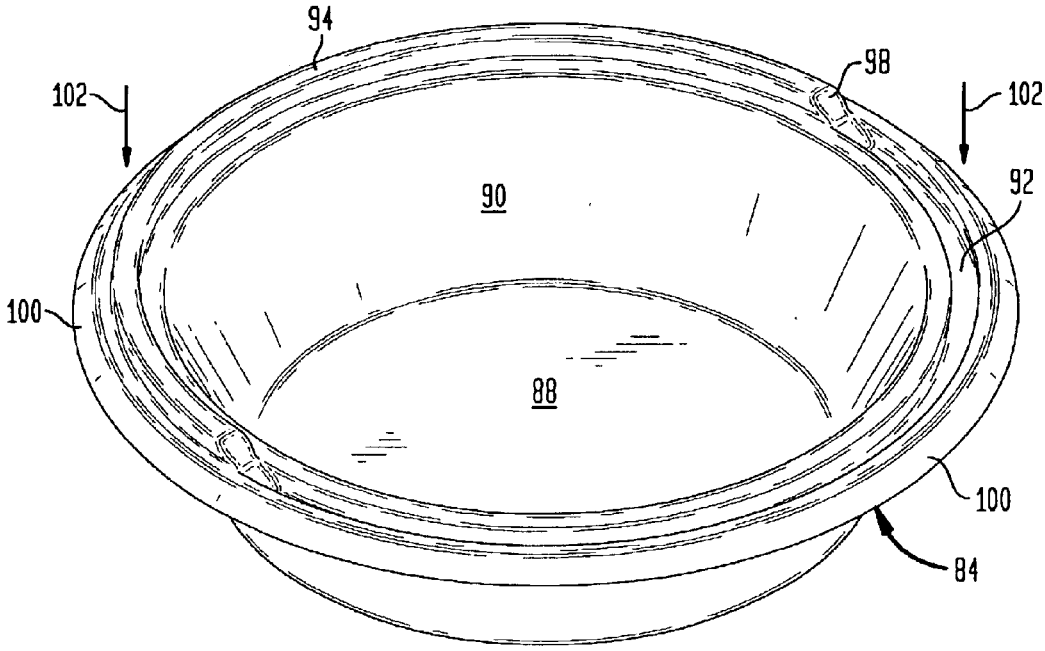

In FIG. 5C container 82 of FIG. 5A is rotated 180° about its axis of rotation such that its respective rim portions will mate with container 84 when it is engaged thereto in the direction shown by arrows 102. There is thus provided a second embodiment of the present invention wherein the rim portions of an identical container are configured to be urged into sealing engagement about their periphery. Most preferably the rim portions contain means for defining a circumferential interlock about the transition sections as was described in detail in connection with the embodiment of FIGS. of 1A through 4.

It is likewise possible to make larger containers having the features of the present invention. There is shown, for example, in FIG. 6, a 2.2 quart dish provided with the inventive rim design. Dish 110 of FIG. 6 includes generally a bottom planar portion 112, a sidewall 114, and a rim portion 116. Rim portion 116 is provided with a first undercut male ridge section 118, a second undercut male ridge section 120 and a third undercut male ridge section 122. An axis of rotation 124 bisects a transition section 126 as well as a transition section 140 in the plane of the rim generally which is indicated at 130. The axis of rotation passes through the plane of the rim. Rim portion 116 is further provided with a first female undercut groove portion 128, a second undercut female groove portion 132 and a third undercut female groove portion 134. Inasmuch as there are three male ridge sections and three female undercut groove portions there are a plurality of transition sections 136–144 in addition to transition section 126.

Figure 6:
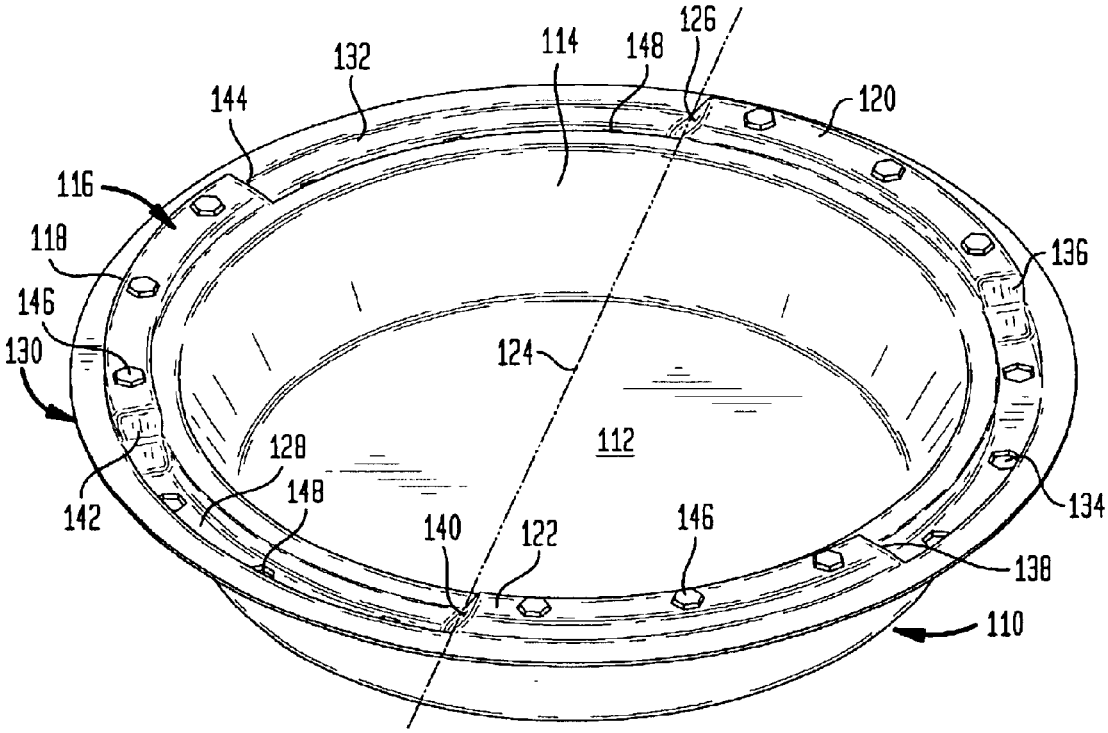
FIG. 6 is a view in perspective of still yet another embodiment of the present invention.
Figure 7:
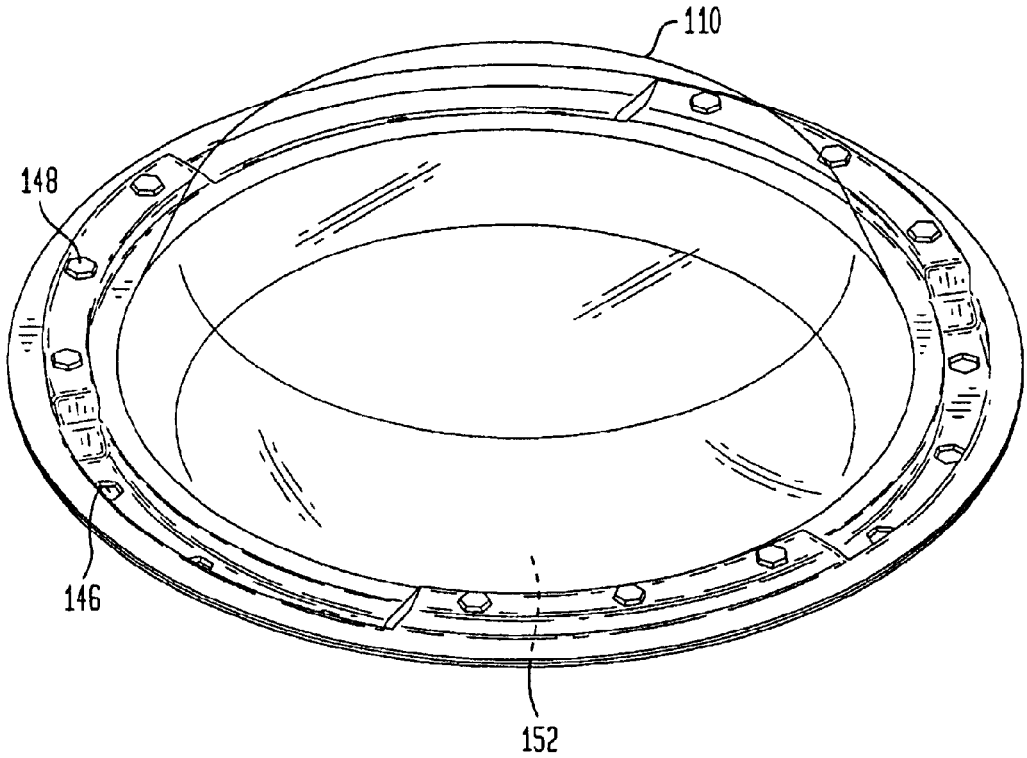
FIG. 7 is a view in perspective of the container of FIG. 6 fitted with a smaller volume container having an identical rim portion to form an enclosed food container in accordance with the present invention.
Figure 8:
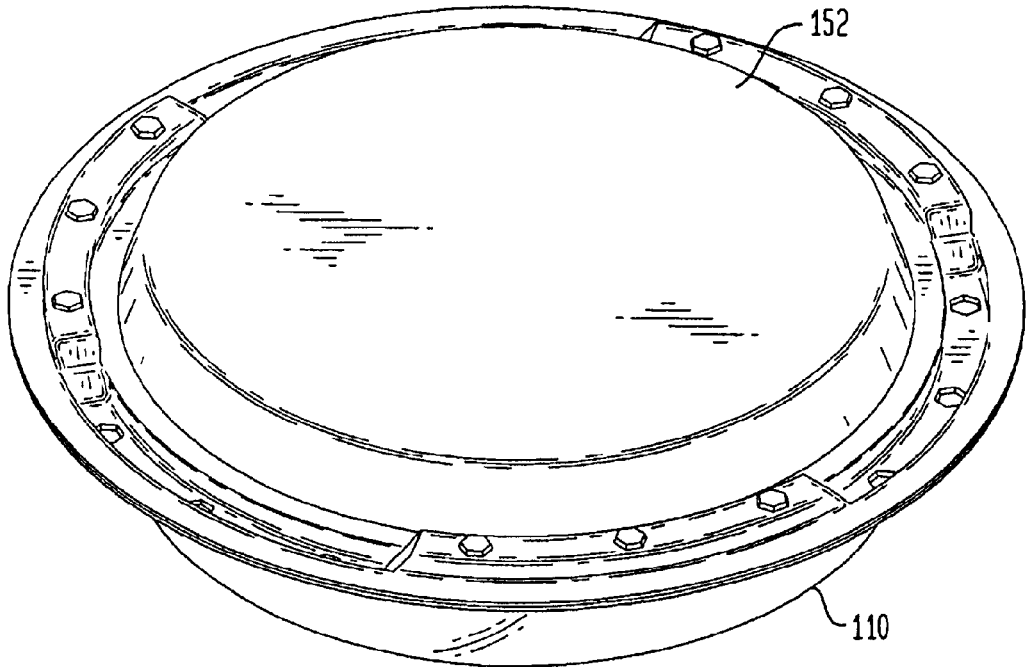
FIG. 8 is a view in perspective of the closed container of FIG. 7 wherein the closed food container has been rotated 180° about a horizontal axis.

There is further provided in accordance with the embodiment FIG. 6, a plurality of relief designs such as designs 146 and 148. Relief design element 146 and 148 are simply relief hexagons embossed and debossed into the respective rim portions of the diagram. For example hexagon 146 is embossed on the medial portion of third undercut male ridge section 122 such that the hexagon design is raised above the surface, whereas hexagon design element 148 is debossed into the medial surface of first undercut female groove portion 128 such that the design element forms a hexagonal cavity in the rim. These relief design elements thus may provide additional sealing if they are configured to fit together in a corresponding container which has the same or substantially the same rim. That is to say if dish 110 were rotated about its axis of rotation 124 the corresponding design elements would interlock when pressed together just as the male ridge sections and female groove sections do, as can be seen in FIGS. 7 and 8. Alternatively, female elements may be used around the entire rim for aesthetic effect if so desired.

The container of FIG. 6 may be matched and pressed together with an identical container as shown in FIGS. 5A through 5D or one could employ a smaller container i.e. one with less depth as shown in FIG. 7 that is provided with a substantially identical rim design. In FIG. 7, for example there is shown a plate 152 having a substantially identical rim to the dish of FIG. 6 wherein the dish of FIG. 6 is used as a dome for covering plate 152. Conversely, there is shown in FIG. 8 dish 110 of FIG. 6, covered with plate 152 of FIG. 7 which also has a substantially identical rim design. In this manner it will be appreciated by one of skill in the art that various configurations in terms of volumes/capacities may be achieved as well as the desired aesthetics for a particular dish. In addition to using two containers of different volume having matched rims, it is possible to use containers with matching rim structures having different color and/or texture in accordance with the present invention; for example when using a dish such as dish 110 as a dome as shown in FIG. 7, for example, it may be desirable to make the dish from an optically clear polystyrene.

Figure 9A:
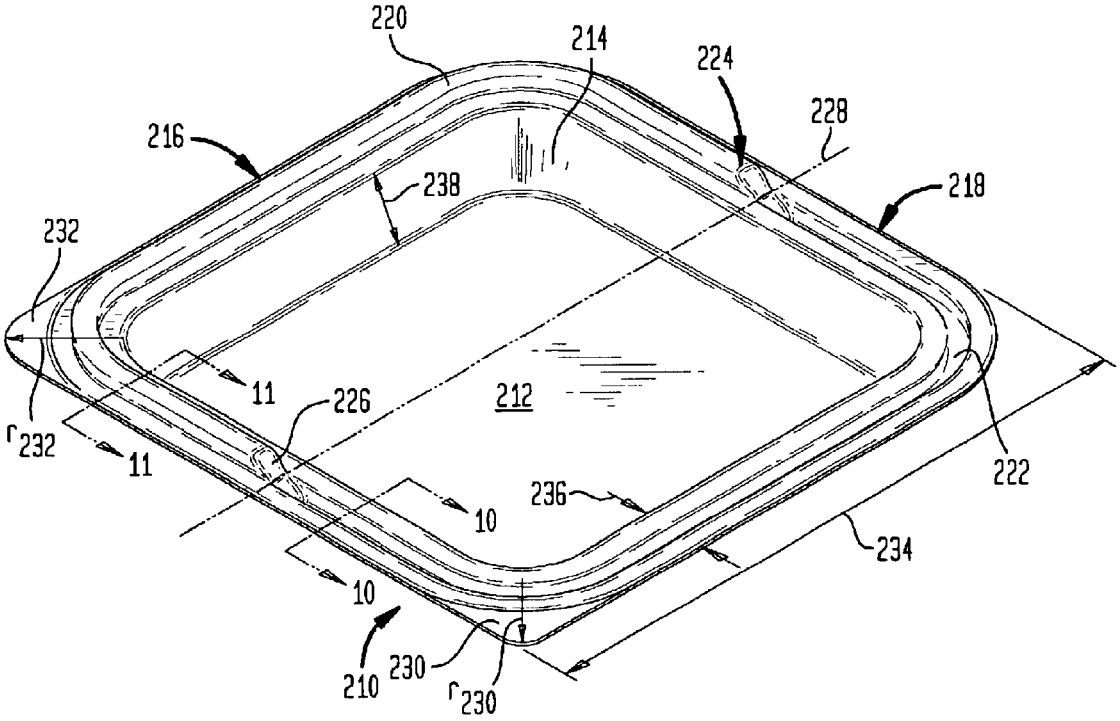
FIG. 9A is a view in perspective of yet another container configured in accordance with the present invention.

Yet another container of the present invention is illustrated in FIGS. 9A through 11. FIG. 9A is a view in perspective of a container 210 which includes generally a planar central container portion 212 which transitions to a sidewall 214 which, in turn, transitions to a rim portion 216 generally in a rim plane indicated at 218.

Rim portion 216 includes a U-shaped male ridge section 220 as well as a U-shaped female groove section 222. In between ridge section 220 and groove section 222 are a pair of transition sections 224 and 226 which transition between the groove and ridge of rim portion 216 of container 210. Container 210 has about the transition section an axis of rotation 228 generally in rim plane 218.

On either side of axis 228 are a first tab 230 and a second tab 232 which may be identical in size or may be slightly different in size. For example, tab 232 may extend a distance r232 from the inner edge of rim 216 as shown whereas tab 230 may extend a distance r230 from a location spaced outwardly from the inner edge of the rim as shown. In a particular embodiment, the container of FIG. 9A may be about 6 inches along each side, that is along dimension 234, rim 216 may have an overall width 236 of about ½ inch or so and the container may have an overall height 238 of an inch or so. Preferably r230 is shorter than r232 by a few millimeters and radiates from a location outward from the inner edge of rim 216 so that the tabs may be readily differentiated when container 210 is engaged to an identical container as is shown in FIG. 9B.

Figure 9B:
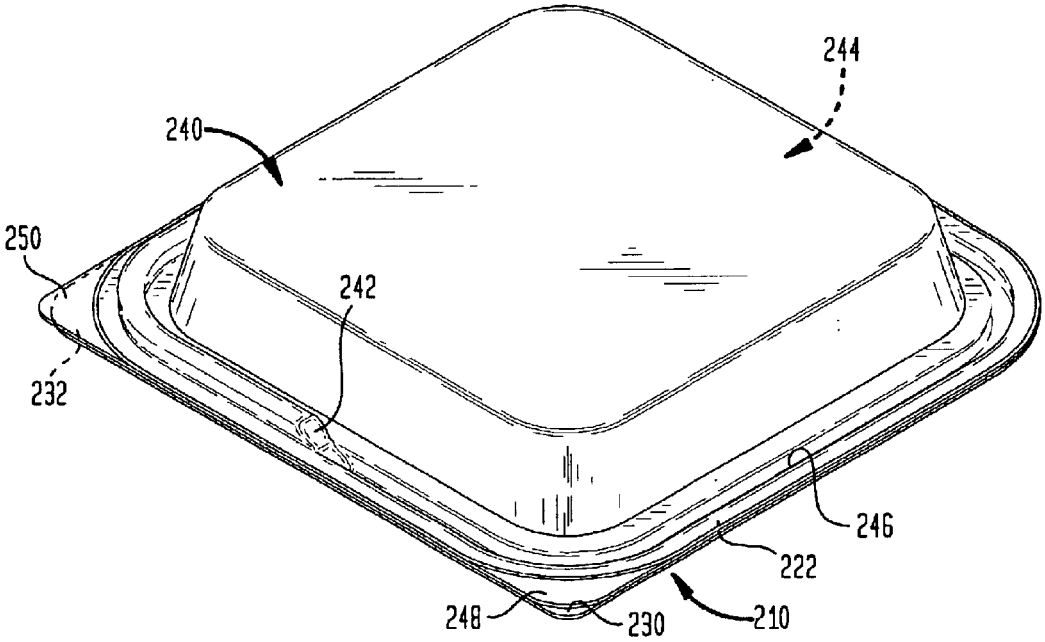
FIG. 9B is a view in perspective of the container of FIG. 9A in sealing engagement with another, identical container.

FIG. 9B is a view in perspective of container 210 wherein an identical container 240 (rotated 180 degrees about an axis of rotation such as axis 228 from the position of container 210 in FIG. 9A) has been sealingly engaged thereto. The closed container thus formed is substantially liquid-proof due to its geometry which is substantially that described in connection with the embodiments of FIGS. 1A through 4. That is to say, the transition portions indicated at 242,244 form a circumferential interlock wherein the various transition surfaces are urged into surface to surface engagement and the ridge sections, such as U-shaped male ridge section 246 of container 240 is urged into surface to surface engagement with female groove section 222 of container 210 by virtue of the geometry of the container as illustrated.

It will be appreciated from FIG. 9B particularly that tab 230 of container 210 protrudes slightly from underneath tab 248 of container 240 since it is slightly larger. Likewise, tab 250 of container 240 projects away from rim 216 slightly more than tab 232 of container 210.

Figure 10:
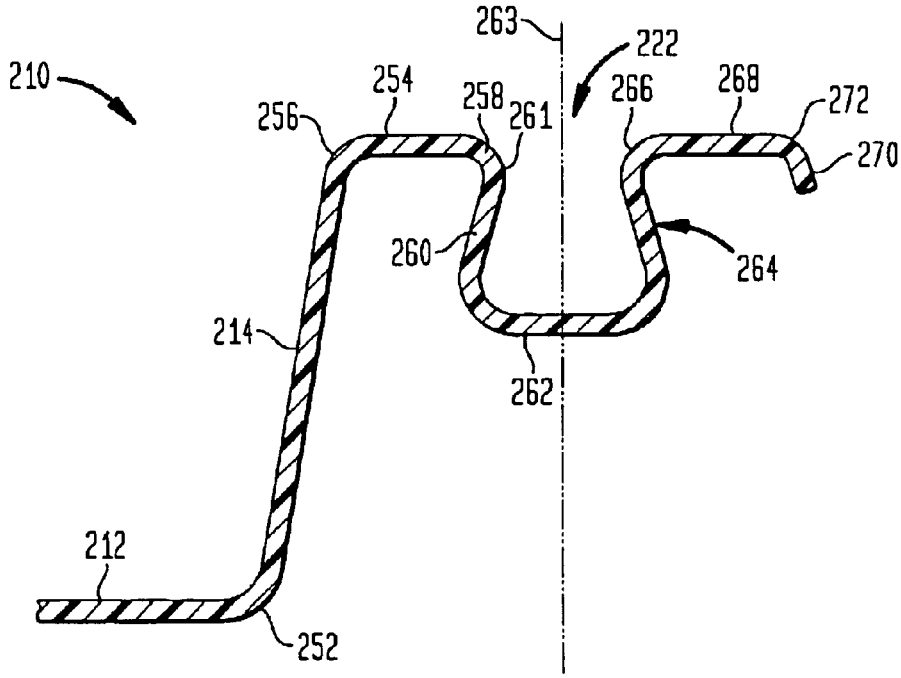
FIG. 10 is a schematic view in elevation and section along line 10—10 of FIG. 9A showing a profile from center of the container.
Figure 11:
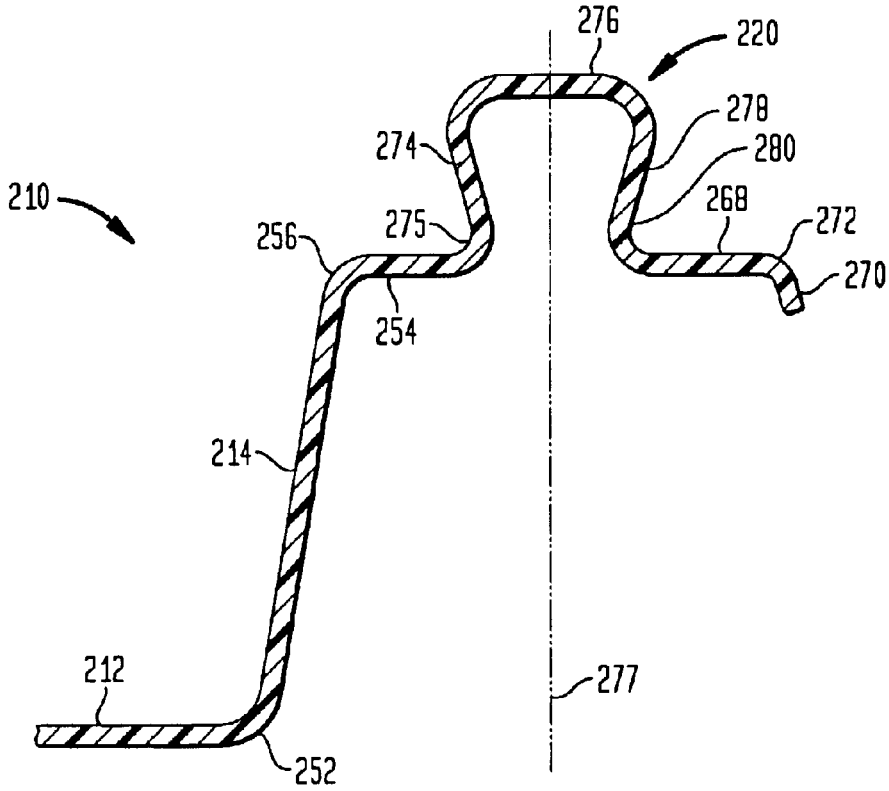
FIG. 11 is a schematic view in elevation and section along line 11—11 of FIG. 9A showing a profile from the center of the container.

While many suitable rim profiles may be employed, various portions of rim 216 of container 210 are shown schematically in FIGS. 10 and 11.

FIG. 10 is a schematic view illustrating the profile from center of container 210, that is, more particularly the profile of U-shaped groove 222 along line 10—10 of FIG. 9A. Generally speaking, the container transitions from planar portion 212 through a first transition section 252 having a first radius of curvature to sidewall 214. Sidewall 214 transitions to a first outwardly extending rim portion 254 through a second transition portion 256. U-shaped groove section 222 is outwardly disposed with respect to portion 254 and connected thereto by way of a third transition section 258.

Groove 222 includes a downwardly extending sidewall 260 having an inner undercut portion 261, a medial planar portion 262, an outer undercut sidewall 264 with undercut portion 266. In general, groove 222 may be symmetrical about a central line 263 shown in the diagram. Groove 222 transitions to a second outwardly extending rim portion 268 which optionally transitions to a downwardly extending lip 270 through a fourth transition 272. Details of ridge section 220 are further illustrated in FIG. 11.

FIG. 11 is a schematic view in elevation and section of container 210 along line 11—11 of FIG. 9A showing the profile of container 210 as it extends outwardly from center. Planar portion 212 transitions to sidewall 214 through transition section 252 as described above. Sidewall 214, in turn, transitions to first outwardly extending rim portion 254 by way of section 256 as noted in connection with FIG. 10.

Ridge 220 is connected to portion 254 as shown and has an inner sidewall 274 provided with inner undercut 275 as well as a medial planar portion 276 corresponding to medial planar portion 262 of groove 222. Ridge 220 also has an outer sidewall 278 which includes an undercut portion 280 suitably configured to cooperate with corresponding groove portions. Thus, U-shaped ridge 276 is generally symmetrical about a line 277 through its center.

Ridge 220 transitions outwardly to second outwardly extending rim portion 268 which transitions through portion 272 to optional downwardly extending lip 270 as noted in connection with FIG. 10.

Figure 12:
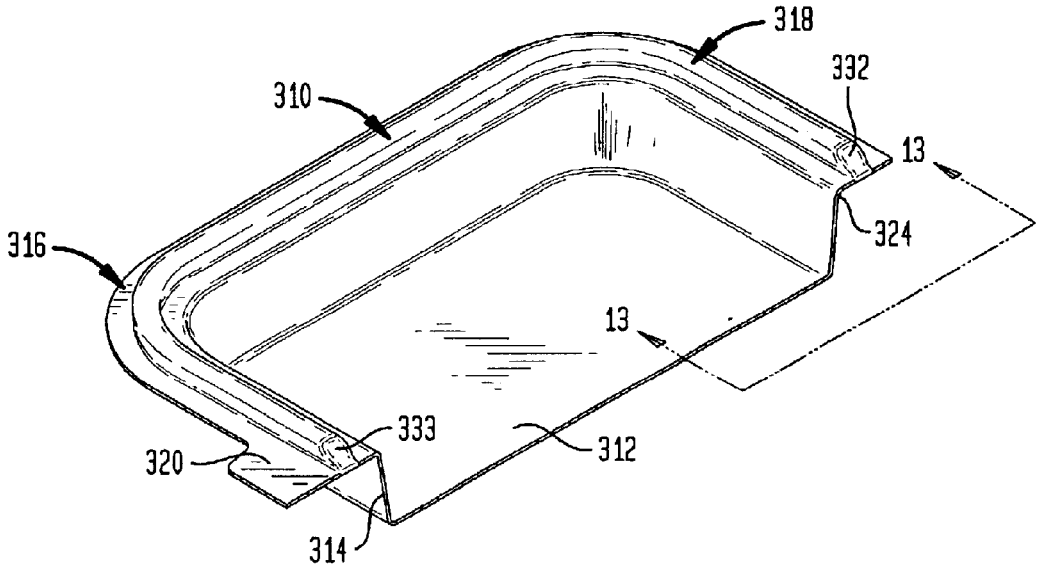
FIG. 12 is a view in perspective and section along the centerline of yet another container of the present invention.

There is shown in FIGS. 12 through 15 still yet another container of the invention. In FIG. 12 there is illustrated in a partial perspective view container 310 along its centerline in section. Container 310 includes generally a central planar portion 312 which transitions to a sidewall 314 which, in turn, transitions to a rim portion 316. There is provided a male U-shaped ridge section 318 as well as a tab 320. Various features of container 310 are perhaps better seen in FIG. 13 which is an enlarged partial view of the container along line 13—13 of FIG. 12. Planar bottom 312 transitions through a transition section 322 to sidewall 314 which, in turn, transitions through transition section 324 to an outwardly extending ring section 326.

Male U-shaped ridge portion 318 connects to ring 326 and includes a sidewall 328 provided with an inner undercut portion 330, as well as a planar medial portion 331. The views of FIGS. 12 and 13 show declivitous transition surfaces 332,333 which correspond to the male transition surfaces described hereinabove, but are provided with a lobed cooperating structure discussed in more detail in connection with FIGS. 14 and 15.

Ridge 318 further includes an outer sidewall 334 provided with an undercut portion 336. The ridge connects to an outer ring 338. The embodiment of FIGS. 12 through 15 is similar in many respects to that of FIG. 1A and following except that the U-shaped ridge and the U-shaped grooves are provided with undercuts along both their inner and outer legs and the transition surfaces have a rounded boss and depression respectively.

Figure 13:
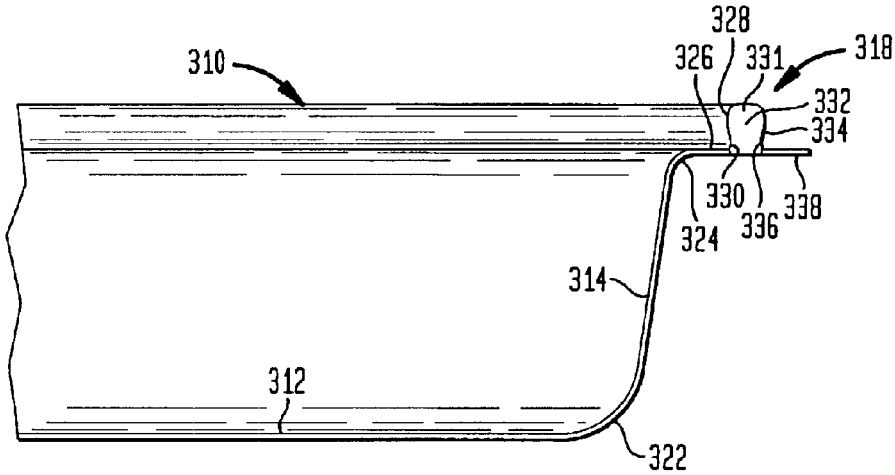
FIG. 13 is an enlarged view in elevation and section along lines 13—13 of FIG. 12 illustrating a profile of a male ridge section having undercuts on both legs of its U-shaped profile from center.
Figure 14:
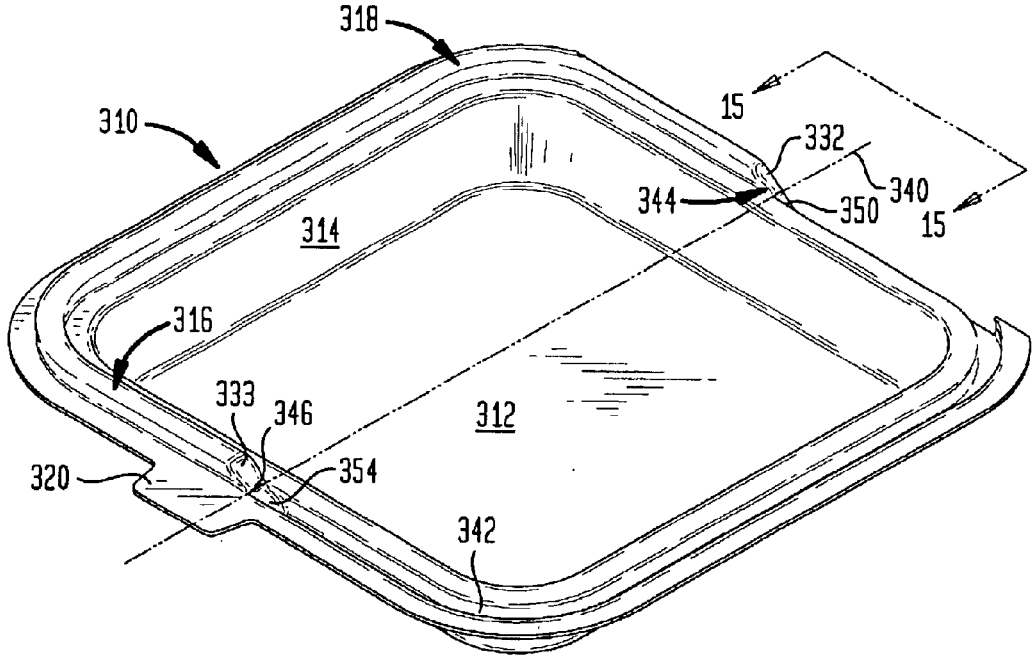
FIG. 14 is a view in perspective and partial section of the container of FIGS. 12 and 13 (similar to that of FIG. 1A) with lobed transition sections between a male ridge and a female groove.

FIG. 14 is a view in perspective of container 310 of FIGS. 12 and 13, partially cut away about transition section 344 as shown in the diagram. U-shaped male ridge 318 transitions to female groove 342 at transition sections 344,346 as shown in FIG. 14. The container is designed, like those described above, to seal in interpenetrating engagement with a substantially identical container rotated 180° about axis 340.

Figure 15:
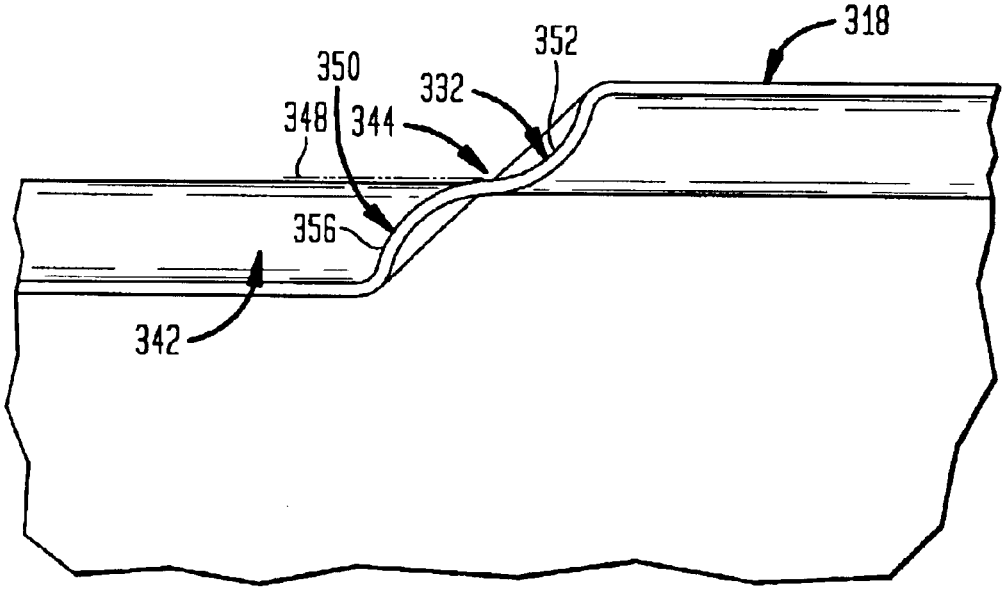
FIG. 15 is a view in elevation and section of the container of FIGS. 12–14 generally along line 15—15 of FIG. 14.

The details of the transition sections are perhaps better appreciated by reference to FIG. 15 which is an enlarged view in elevation and section along line 15—15 of FIG. 14.

Transition section 344 includes an upper declivitous surface 332 extending downwardly to a lower acclivitous surface 350. Surface 332 extends generally downwardly from ridge 318 to the rim plane whereas surface 350 extends generally upwardly from the bottom of groove 342 to the rim plane generally indicated at 348.

Surface 332 has a lobed or rounded structure 352 generally bowed toward planar portion 312 of container 310 whereas surface 350 has a lobed structure 356 generally bowed away of planar portion 312 of container 310. So also, transition section 346 has a declivitous surface 333 of like geometry to surface 332 and an acclivitous lower surface 354 of like geometry to acclivitous surface 350. Thus, an identical container rotated 180° about an axis of rotation defined thereby will fit into engagement with container 310 wherein the acclivitous surfaces will engage into surface-to-surface sealing contact with the declivitous surfaces as noted in connection with FIG. 2B above. That is to say, a declivitous surface such as surface 332 with contact on acclivitous surface configured such as surface 350 such that lobes such as lobe 352 bowed towards portion 312 will be in surface-to-surface contact with lobes such as lobes 356 which extend away from the bottom of the container.

Figure 16:
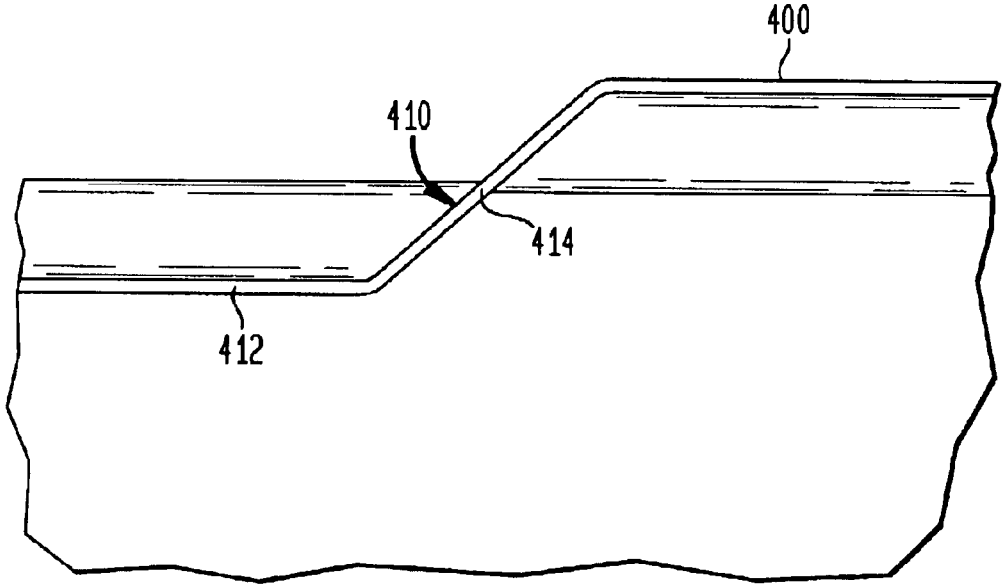
FIG. 16 is a view in section and elevation of an alternate circumferential profile showing a preferred planar transition section between an undercut male ridge section and an undercut female groove.

While the present invention has been described in detail with reference to particular embodiments, modifications within the spirit and scope of the present invention to those embodiments will be readily apparent to those of skill in the art. For example, while transition sections having a plurality of discreet surface portions have been illustrated in connection with FIGS. 1A through 15 above, it may be possible to utilize a transition section having a generally planar configuration as shown in FIG. 16. In FIG. 16 there is shown schematically a circumferential section of a container as is illustrated in FIG. 15, wherein a transition section 410 extends from the top of a generally U-shaped male ridge section 400 generally as described above to the lower surface of a female undercut groove section 412. Transition section 410 consists of a single planar surface 414 which will sealingly engage a corresponding transition section of another suitably configured container provided that the undercut groove and undercut ridges provide enough compressive circumferential force to urge surface 414 into surface-to-surface contact with another substantially planar surface. So also, containers of any suitable shape with a flange ridge extending partially around its outer periphery and a flange groove extending partially about its outer periphery may be configured in accordance with the present invention. Such shapes may include oval shapes, square shapes with rounded corners, round shapes, multi-sided shapes and so forth. While an undercut groove and ridge geometry is typically preferred with most thermoplastic materials, a tapered or wedge fit geometry may be suitable with softer material or other material with a relatively high coefficient of friction. The invention is defined in the appended claims.

What is claimed is:

1. A thermoplastic container having an interlocking rim structure defined about the periphery thereof, said interlocking rim structure having at least one undercut male ridge section and at least one undercut female groove section defined therein, wherein said ridge section and said groove section have generally identical U-shapes, said male and female sections being configured such that male and female sections on a container having a substantially identical interlocking rim structure will seal with interpenetrating resilient engagement extending substantially entirely around the periphery of said thermoplastic container, the undercuts on said ridges and grooves being configured to urge the rim structures on containers having substantially identical interlocking rim structures into sealing engagement, by virtue of the undercut male ridge section mating with a corresponding overhang of the undercut female groove section and the undercut female groove section mating with a corresponding overhang of the undercut male ridge section.

2. The thermoplastic container of claim 1 wherein terminal portions of said ridge sections transition into said groove sections, defining declivitous transition surfaces on said ridge sections and acclivitous transition surfaces within said groove sections, said declivitous transition surfaces and said acclivitous transition surfaces abutting one another and being configured to be urged into sealing surface to surface engagement with like transition surfaces upon interpenetration of male and female sections of said container with male and female sections of a thermoplastic container having a substantially identical interlocking rim structure.

3. The container according to claim 2, wherein said acclivitous surfaces and said declivitous surfaces are lobed surfaces.

4. The container according to claim 3, wherein said lobed surfaces include spherically lobed portions.

5. The thermoplastic container of claim 1, wherein said male ridge section and said female ridge section each include an inner and outer sidewall and said inner and outer sidewalls are undercut.

6. The thermoplastic container of claim 1, wherein said U-shaped undercut male ridge section and said U-shaped undercut female groove section are undercut on both sidewalls thereof.

7. The thermoplastic container of claim 6, wherein said undercut male ridge section and said undercut female groove section each include a substantially planar medial portion.

8. The thermoplastic container according to claim 1, wherein said interlocking rim structure further comprises two peripheral tabs distally located with respect to an axis of rotation such that said tabs will substantially overlap with substantially identical tabs on the rim structure of another container having a substantially identical rim structure when the respective rim structures are interlocked in sealing engagement and the overlapping tabs are distally located with respect to the respective axes of rotation of said containers.

9. The thermoplastic container according to claim 8, wherein said peripheral tabs are of substantially similar yet distinct dimensions so that the overlapping tabs may be readily distinguished and separated from one another.

10. The thermoplastic container according to claim 2, wherein said interlocking rim structure further comprises at least one peripheral tab distally located with respect to said transition surfaces.

11. The thermoplastic container according to claim 10, wherein said interlocking rim structure comprises at least two peripheral tabs distally located with respect to said transition surfaces.

12. The thermoplastic container according to claim 1, fabricated from a thermoplastic material by way of a technique selected from the group consisting of injection molding, injection blowmolding, compression molding, injection stretch blowmolding and composite injection molding.

13. The thermoplastic container of claim 1, formed from a sheet of thermoplastic material.

14. The thermoplastic container according to claim 13, wherein said container is thermoformed, thermoformed by the application of vacuum or thermoformed by a combination of vacuum and pressure.

15. The thermoplastic container according to claim 14, thermoformed by the application of vacuum.

16. The thermoplastic container according to claim 13, wherein said thermoplastic material is selected from the group consisting of: polyamides, polyacrylates, polysulfones, polyetherketones, polycarbonates, acrylics, polyphenylene sulfides, liquid crystal polymers, acetals, cellulosic polymers, polyetherimides, polyphenylene ethers or oxides, styrene-maleic anhydride copolymers, styrene-acrylonitrile copolymers, polyvinytchlorides and mixtures thereof.

17. The thermoplastic container of claim 13, wherein said thermoplastic material comprises a polymeric material selected from the group consisting of: polyesters, polystyrenes; polypropylenes; polyethylenes; and mixtures thereof.

18. The thermoplastic container of claim 17, wherein said container has a wall thickness of from about 5 to about 50 mils.

19. The thermoplastic container according to claim 18, wherein said container has a wall thickness of from about 15 mils to about 25 mils.

20. The thermoplastic container according to claim 13, formed from a foamed polymeric material having a wall thickness of from about 5 to about 80 mils.

21. The thermoplastic container according to claim 17, wherein said polymeric material is a polystyrene.

22. The thermoplastic container according to claim 21, wherein said polystyrene is high impact polystyrene.

23. The thermoplastic container according to claim 21, wherein said polystyrene is oriented polystyrene.

24. The thermoplastic container according to claim 17, wherein said polymeric material is polypropylene.

25. The thermoplastic container of claim 24, wherein said polypropylene is mineral-filled.

26. The thermoplastic container according to claim 25, wherein said mineral-filler comprises mica and wherein said polymeric material comprises from about 40 to about 90% by weight polypropylene and from about 10 to about 50% by weight mica.

27. The thermoplastic container according to claim 26, further comprising calcium carbonate.

28. The thermoplastic container according to claim 27, wherein said thermoplastic material comprises a mineral filler.

29. The thermoplastic container according to claim 27, wherein said thermoplastic material comprises an impact modifier.

30. The thermoplastic container according to claim 27, wherein said thermoplastic material comprises a UV stabilizer.

31. The thermoplastic container according to claim 27, wherein said thermoplastic material comprises an antioxidant.

32. The thermoplastic container according to claim 27, wherein said thermoplastic material comprises a thermal stabilizer.

33. A thermoplastic container having an interlocking rim structure defined about the periphery thereof, said interlocking rim structure having at least one undercut male ridge section and at least one undercut female groove section defined therein, wherein said ridge section and said groove section have generally identical U-shapes, said male and female sections being configured such that male and female sections on a substantially identical container will seal with interpenetrating resilient engagement extending substantially entirely around the periphery of said thermoplastic container, the undercuts on said ridges and grooves being configured to urge the rim structures on substantially identical containers into sealing engagement, by virtue of the undercut male ridge section mating with a corresponding overhang of the undercut female groove section and the undercut female groove section mating with a corresponding overhang of the undercut male ridge section.

34. The thermoplastic container of claim 33, wherein terminal portions of said ridge sections transition into said groove sections, defining declivitous transition surfaces on said ridge sections and acclivitous transition surfaces within said groove sections, said declivitous transition surfaces and said acclivitous transition surfaces abutting one another and being configured to urge into sealing surface-to-surface engagement with like transition surfaces upon interpenetration of male and female sections of said container with male and female sections of the substantially identical thermoplastic container.

35. The container according to claim 34, wherein said acclivitous surfaces and said declivitous surfaces are lobed surfaces.

36. The container according to claim 35, wherein said lobed surfaces include spherically lobed portions.

37. The thermoplastic container of claim 33, wherein said male ridge section and said female ridge section each include an inner and outer sidewall and said inner and outer sidewalls are undercut.

38. The thermoplastic container of claim 33, wherein said U-shaped undercut male ridge section and said U-shaped undercut female groove section are undercut on both sidewalls thereof.

39. The thermoplastic container of claim 38, wherein said undercut male ridge section and said undercut female groove section each include a substantially planar medial portion.

40. The thermoplastic container according to claim 33, wherein said interlocking rim structure further comprises two peripheral tabs distally located with respect to an axis of rotation such that said tabs will substantially overlap with substantially identical tabs on the rim structure of another substantially identical container when the respective rim structures are interlocked in sealing engagement and the overlapping tabs are distally located with respect to the respective axes of rotation of said container.

41. The thermoplastic container according to claim 40, wherein said peripheral tabs are of substantially similar yet distinct dimensions so that the overlapping tabs may be readily distinguished and separated from one another.

42. The thermoplastic container according to claim 33, wherein said interlocking rim structure further comprises at least one peripheral tab distally located with respect to said transition surfaces.

43. The thermoplastic container according to claim 42, wherein said interlocking rim structure comprises at least two peripheral tabs distally located with respect to said transition surfaces.

44. The thermoplastic container according to claim 33, fabricated from a thermoplastic material by way of a technique selected from the group consisting of injection molding, injection blowmolding, compression molding, injection stretch blowmolding and composite injection molding.

45. The thermoplastic container of claim 33, thermoformed from a sheet of thermoplastic material.

46. The thermoplastic container according to claim 45, wherein said container is thermoformed, thermoformed by the application of vacuum or thermoformed by a combination of vacuum and pressure.

47. The thermoplastic container according to claim 46, thermoformed by the application of vacuum.

48. The thermoplastic container according to claim 45, wherein said thermoplastic material is selected from the group consisting of: polyamides, polyacrylates, polysulfones, polyetherketones, polycarbonates, acrylics, polyphenylene sulfides, liquid crystal polymers, acetals, cellulosic polymers, polyetherimides, polyphenylene ethers or oxides, styrene-maleic anhydride copolymers, styrene-acrylonitrile copolymers, polyvinylchlorides and mixtures thereof.

49. The thermoplastic container of claim 45, wherein said thermoplastic material comprises a polymeric material selected from the group consisting of: polyester, polystyrene; polypropylene; polyethylene; and mixtures thereof.

50. The thermoplastic container according to claim 49, wherein said container has a wall thickness of from about 5 mils to about 50 mils.

51. The thermoplastic container according to claim 50, wherein said container has a wall thickness of from about 15 mils to about 25 mils.

52. The thermoplastic container according to claim 45, formed from a foamed polymeric material having a wall thickness of from about 5 to about 80 mils.

53. The thermoplastic container according to claim 49, wherein said thermoplastic material comprises a mineral filler.

54. The thermoplastic container according to claim 49, wherein said thermoplastic material comprises an impact modifier.

55. The thermoplastic container according to claim 49, wherein said thermoplastic material comprises a UV stabilizer.

56. The thermoplastic container according to claim 49, wherein said thermoplastic material comprises an antioxidant.

57. The thermoplastic container according to claim 49, wherein said thermoplastic material comprises a thermal stabilizer.

58. A container integrally formed of a thermoplastic material having an interlocking rim structure about a rim plane defined about the periphery thereof, said interlocking structure comprising:

(a) at least one undercut male ridge section projecting upwardly from said rim plane extending circumferentially over at least a portion of the periphery of said container having at its terminal portions declivitous sealing surfaces projecting downwardly toward said rim plane;

(b) at least one undercut female groove section adjacent said undercut male ridge section extending circumferentially over at least a portion of the periphery of said container having at its terminal portions acclivitous sealing surfaces projecting upwardly toward said rim plane, said acclivitous surfaces abutting said declivitous surfaces, wherein said ridge section and said groove section have generally identical U-shapes;

said interlocking rim structure being configured to seal with a substantially identical rim structure rotated 180° about an axis of rotation such that when the male ridge sections are disposed in sealing engagement with corresponding female groove sections the ridges and grooves are urged into surface-to-surface engagement, the surface-to-surface engagement extending substantially entirely around the periphery of the container and wherein corresponding acclivitous and declivitous surfaces are urged into surface-to-surface sealing contact, and wherein further the undercut male ridge section mates with a corresponding overhang of the undercut female groove section and the undercut female groove section mates with a corresponding overhang of the undercut male ridge section.

59. The container according to claim 58, wherein said acclivitous surfaces and said declivitous surfaces are lobed surfaces.

60. The container according to claim 59, wherein said lobed surfaces include spherically lobed portions.

61. The container according to claim 58, wherein said male ridge section is an undercut male ridge section and said female groove section is an undercut female groove section.

62. A container integrally formed of a thermoplastic material having an interlocking rim structure about a rim plane defined about the periphery thereof, said interlocking rim structure comprising:

(a) at least one undercut male ridge section projecting upwardly from said rim plane extending circumferentially over at least a portion of the periphery of said container having two terminal portions with inclined declivitous surfaces extending from the top surface of said male ridge section to about said rim plane;

(b) at least one undercut female groove section adjacent said undercut male ridge section projecting downwardly from said rim plane extending circumferentially over at least a portion of the periphery of said container having two terminal portions with inclined acclivitous surfaces extending from the bottom surface of said groove upwardly to about said rim plane in proximity to said inclined male surfaces wherein said ridge section and said groove section have generally identical U-shapes, said rim structure being configured such that it defines an axis of rotation in said rim plane extending between at least one of said inclined declivitous surfaces and at least one of said inclined acclivitous surfaces and wherein said rim structure is configured to seal with a substantially identical rim structure rotated 180° about said axis of rotation such that the male ridge sections are disposed in sealing engagement with corresponding female groove sections, the sealing engagement extending substantially entirely around the periphery of the container and the terminal inclined surfaces are urged to engage to form circumferential interlocks, and wherein further the undercut male ridge section mates with a corresponding overhang of the undercut female groove section and the undercut female groove section mates with a corresponding overhang of the undercut male ridge section.

63. The container of claim 62, wherein said undercut male ridge section and said undercut female groove section each include a substantially planar medial portion.

64. The container according to claim 62, wherein said acclivitous surfaces and said declivitous surfaces are lobed surfaces.

65. The container according to claim 64, wherein said lobed surfaces include spherically lobed portions.

66. The thermoplastic container according to claim 62, fabricated from a thermoplastic material by way of a technique selected from the group consisting of: injection molding, injection blowmolding, compression molding, injection stretch blowmolding and composite injection molding.

67. The thermoplastic container according to claim 62, wherein said thermoplastic material comprises a thermoplastic polymer selected from the group consisting of: polyesters, polystyrenes, polypropylenes, polyethylenes and mixtures thereof.

68. The thermoplastic container according to claim 67, wherein said thermoplastic material comprises a mineral filler.

69. The thermoplastic container according to claim 67, wherein said polymeric material includes one or more adjuvants to modify polymer properties selected from: impact modifiers, UV stabilizers, antioxidants and thermal stabilizers.

70. The thermoplastic container according to claim 62, formed from a sheet of thermoplastic material.

71. The thermoplastic container according to claim 70, wherein said container is thermoformed, thermoformed by application of vacuum or thermoformed by application of pressure and vacuum.

72. The thermoplastic container according to claim 71, wherein said container is thermoformed by application of vacuum.

73. The thermoplastic container according to claim 70, wherein said thermoplastic material comprises a styrene polymer.

74. The thermoplastic container according to claim 70, wherein said thermoplastic material comprises a propylene polymer.

75. The thermoplastic container according to claim 74, wherein said polymeric material comprises mica-filled polypropylene.

76. The thermoplastic container according to claim 70, wherein said thermoplastic container comprises an ethylene polymer.

77. A thermoplastic container having an interlocking rim structure defined about the periphery thereof, said interlocking rim structure having at least one undercut male ridge section and at least one undercut female groove section defined therein, wherein said ridge section and said groove section have generally identical U-shapes, said male and female sections being configured such that male and female sections on a container having a substantially identical interlocking rim structure will seal with interpenetrating resilient engagement extending substantially entirely around the periphery of said thermoplastic container, the undercuts on said ridges and grooves being configured to urge the rim structures on containers having substantially identical interlocking rim structures into sealing engagement, by virtue of the undercut male ridge section mating with a corresponding overhang of the undercut female groove section and the undercut female groove section mating with a corresponding overhang of the undercut male ridge section, the sealing engagement between the male ridge section and the female groove section being further characterized in that the engagement extends from the undercut of the female groove section to the undercut of the male ridge section.

78. A thermoplastic container having an interlocking rim structure defined about the periphery thereof, said interlocking rim structure having at least one undercut male ridge section with two ridge sidewalls and a ridge medial portion therebetween; and at least one undercut female groove section defined therein, the female groove section also being characterized by two sidewalls and a groove medial portion therebetween; wherein said ridge section and said groove section have generally identical U-shapes, said male and female sections being configured such that male and female sections on a container having a substantially identical interlocking rim structure will seal with interpenetrating resilient engagement extending substantially entirely around the periphery of said thermoplastic container, the undercuts on said ridges and grooves being configured to urge the rim structures on containers having substantially identical interlocking rim structures into sealing engagement, by virtue of the undercut male ridge section mating with a corresponding overhang of the undercut female groove section and the undercut female groove section mating with a corresponding overhang of the undercut male ridge section, the sealing engagement between the groove and ridge being further characterized in that, as the undercuts of the groove and ridge are urged into engagement, substantial surface to surface contact between the medial portions of the groove form an additional seal.

* * * * *